US010455865B2

(12) United States Patent
Barski

(10) Patent No.: US 10,455,865 B2
(45) Date of Patent: Oct. 29, 2019

(54) EXPANDABLE SWADDLING GARMENT

(71) Applicant: Karen H Barski, Milton, GA (US)

(72) Inventor: Karen H Barski, Milton, GA (US)

( * ) Notice: Subject to any disclaimer, the term of this patent is extended or adjusted under 35 U.S.C. 154(b) by 72 days.

(21) Appl. No.: 15/938,273

(22) Filed: Mar. 28, 2018

(65) Prior Publication Data

US 2018/0317566 A1 Nov. 8, 2018

Related U.S. Application Data

(60) Provisional application No. 62/529,579, filed on Jul. 7, 2017, provisional application No. 62/501,836, filed on May 5, 2017.

(51) Int. Cl.
*A41B 13/06* (2006.01)
*A47G 9/08* (2006.01)

(52) U.S. Cl.
CPC ..... *A41B 13/06* (2013.01); *A47G 9/083* (2013.01); *A41B 2300/322* (2013.01); *A41B 2300/324* (2013.01); *A41B 2500/00* (2013.01)

(58) Field of Classification Search
CPC ..... A41B 13/06; A41D 15/002
See application file for complete search history.

(56) References Cited

U.S. PATENT DOCUMENTS

| | | | | |
|---|---|---|---|---|
| 2,036,175 | A * | 3/1936 | Hollander | A41B 13/06 5/413 R |
| 2,431,603 | A * | 11/1947 | Zito | A41B 13/06 5/413 R |
| 2,455,884 | A * | 12/1948 | Steigerwald | A41B 13/06 128/873 |
| 5,621,917 | A * | 4/1997 | Howsden | A41B 13/06 2/111 |
| 5,708,977 | A | 1/1998 | Morkunas | |
| 6,058,508 | A | 5/2000 | Brown | |
| 6,393,612 | B1 | 5/2002 | Thach | |
| D669,659 | S | 10/2012 | Barski | |
| D696,486 | S | 12/2013 | Barski | |
| 8,607,364 | B2 | 12/2013 | Barski | |
| D718,017 | S | 11/2014 | Barski | |
| D728,198 | S | 5/2015 | Barski | |
| D728,199 | S | 5/2015 | Baraki | |
| 2010/0257654 | A1 | 10/2010 | Waters | |
| 2011/0088136 | A1 | 4/2011 | Isler | |
| 2013/0139290 | A1 | 6/2013 | Barski | |
| 2014/0068834 | A1 | 3/2014 | Skinner | |
| 2015/0342263 | A1* | 12/2015 | Taylor | A41B 13/06 2/69.5 |

* cited by examiner

*Primary Examiner* — Tajash D Patel
(74) *Attorney, Agent, or Firm* — Mark P. Stone

(57) ABSTRACT

An infant sleeping garment has a main body formed from a front surface joined to a rear surface by overlapping material from the front and rear surfaces. The overlapping material provide and intermediate area between the front and rear surfaces of the garment. The width of the intermediate area is selectively adjustable to vary the volume of the main body of the garment to accommodate the same infant as he or she grows, or to accommodate different infants of different sizes in the same adjustable garment.

15 Claims, 14 Drawing Sheets

EXPANDABLE SWADDLING GARMENT

The present patent application claims the benefit of U.S. Provisional Patent Application No. 62/501,836, filed on May 5, 2017, and U.S. provisional Patent Application No. 62/529,579, filed on Jul. 7, 2017.

BACKGROUND OF THE INVENTION

The present invention is generally directed to a sleeping garment, including a swaddling garment or sleep sack, for infants.

U.S. Pat. No. 8,607,364, issued to the present Applicant and Inventor on Dec. 17, 2013, discloses a peanut shaped swaddling garment in which the top portion of the garment has a volume which is substantially equal to the volume of the bottom portion of the garment, and in which the top and bottom portions of the garment are substantially of the same configuration and are substantially symmetrically oriented relative to the middle of the body of the garment. The disclosure of U.S. Pat. No. 8,607,364 is in its entirety expressly incorporated by reference into the present patent application.

The drawings illustrate the preferred embodiment of the present invention as embodied in an infant sleeping garment comprising a swaddling garment having a main body or shell for accommodating an infant therein. The advantage of a swaddling garment in the shape illustrated by the drawing is discussed in detail in U.S. Pat. No. 8,607,364.

Although the garment in accordance with the present invention has been described as being embodied within a peanut shaped swaddling garment, other infant sleeping garments, including other shaped swaddling garments and sleep sacks, are within the scope of the present invention.

The preferred embodiment of the swaddling garment of the present application generally is of a peanut shape configuration in which the lower portion of the main body is wider and longer than the upper portion of the main body to provide more hip room for an infant. Thus, the body of the garment, as illustrated by the enclosed drawings, is not necessarily limited to a configuration in which the top and bottom portions are of substantially equal volume or configuration, or are symmetrically oriented relative to the middle of the body of the garment, although such configurations of the garment are also within the scope of the present invention. Swaddling garments of configurations other than peanut shaped, as well as conventional sleep sacks which widen in a direction from top to bottom and have a substantially flat bottom end, are also within the scope of the present invention.

SUMMARY OF THE INVENTION

A swaddling garment includes a main body or shell having a front surface and a rear surface separated by a predetermined distance. The front and rear surfaces of the swaddling garment are joined together by overlapping material from these surfaces which define an intermediate area between the surfaces. The predetermined distance of separation between the surfaces is selectively adjustable by controlling the width of extension of the overlapping material between the front and rear surfaces of the garment. Accordingly, the volume of the main body of the garment is adjustable, at the selection of the user, to accommodate an infant as he or she grows in height or weight, and/or accommodate different infants of different heights and weights in the same adjustable garment.

DESCRIPTION OF THE BEST MODES FOR CARRYING OUT THE INVENTION

Figure 1:
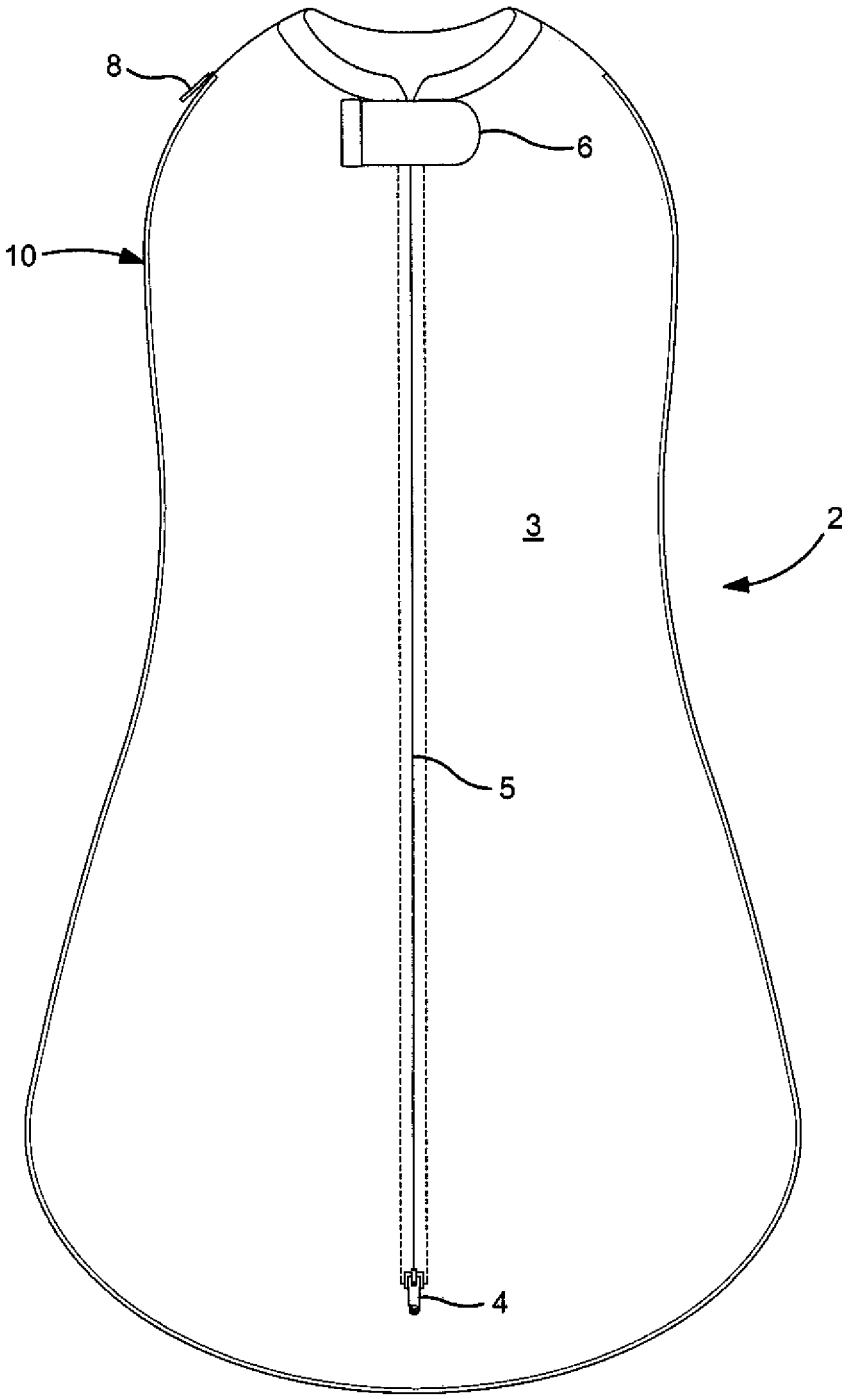
FIG. 1 illustrates a front elevational view of a the Expandable Swaddling Garment, in a contracted configuration, showing my new design.
Figure 2:
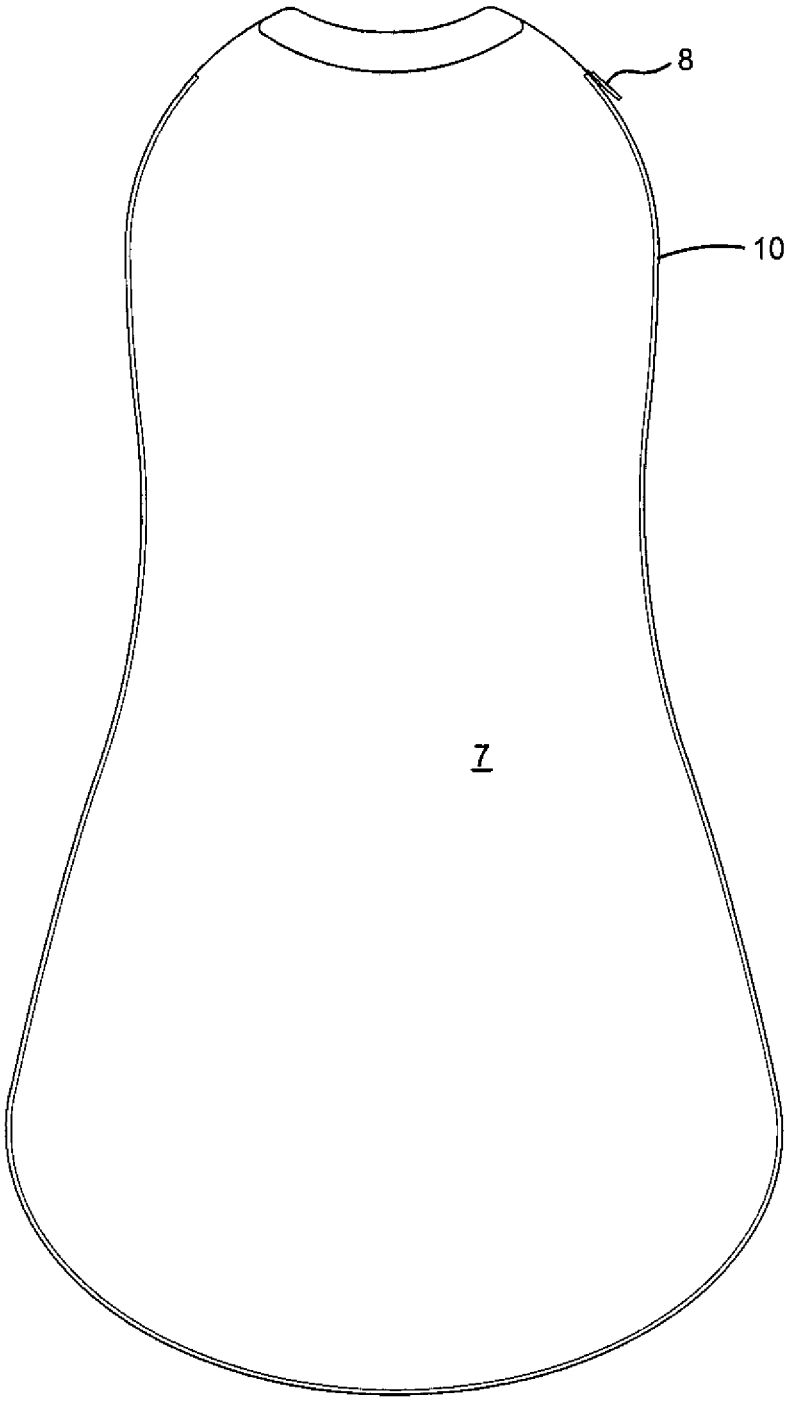
FIG. 2 illustrates a rear elevational view thereof.
Figure 3:
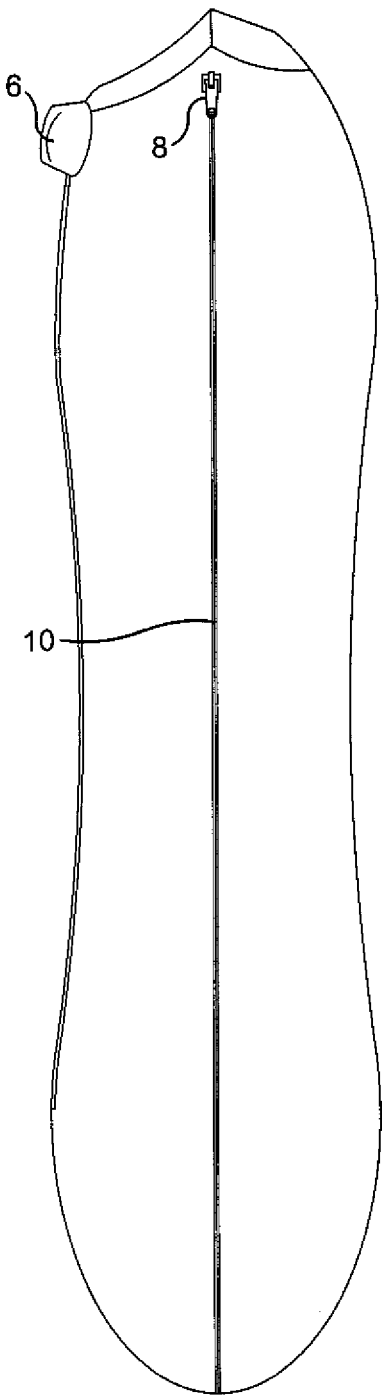
FIG. 3 illustrates a right side elevational view thereof.
Figure 4:
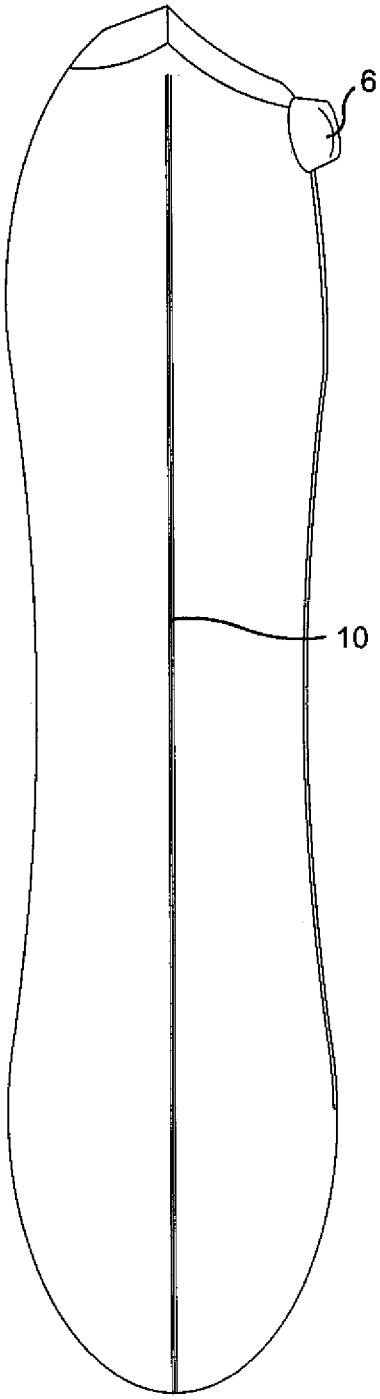
FIG. 4 illustrates a left side elevational view thereof.
Figure 5:
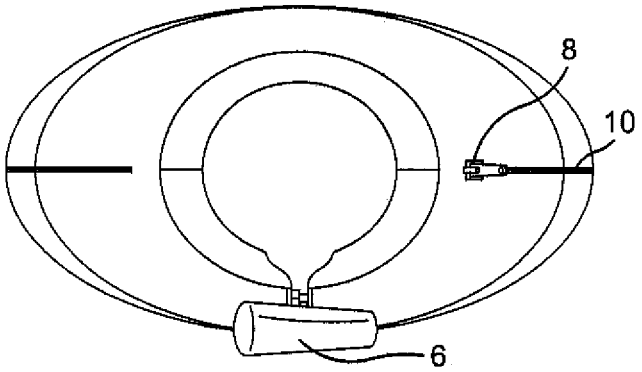
FIG. 5 illustrates a top plan view thereof.
Figure 6:
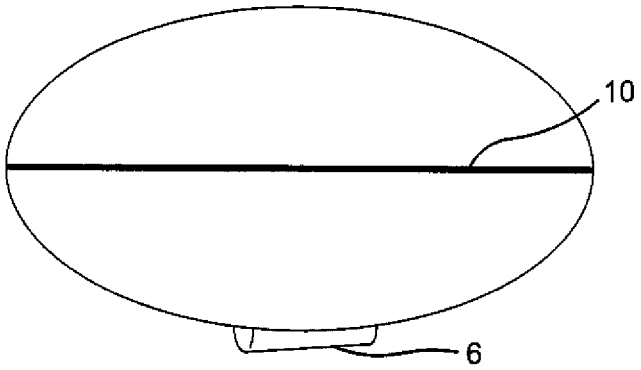
FIG. 6 illustrates a bottom plan view thereof.
Figure 7:
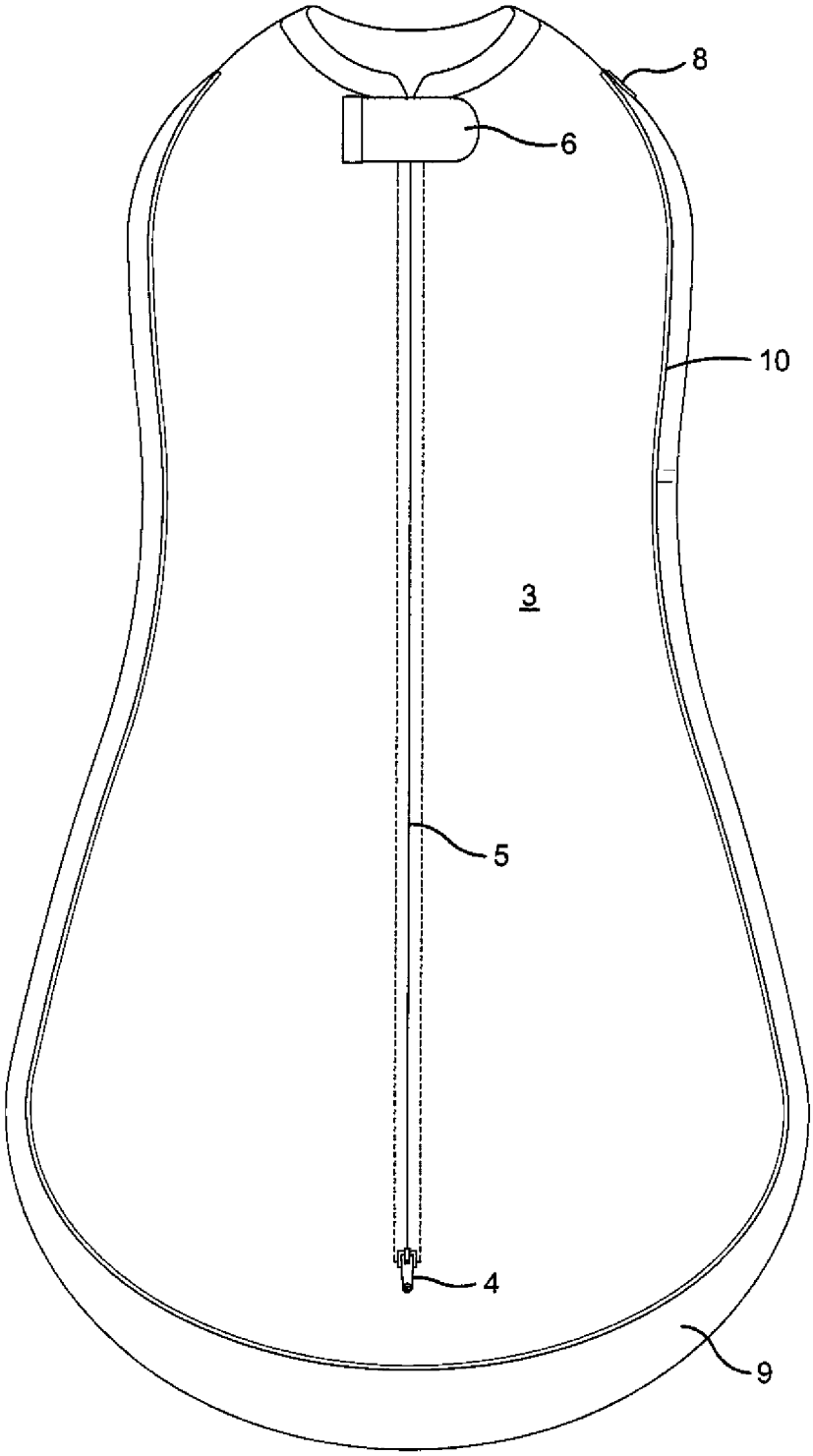
FIG. 7 illustrates a front elevational view of the Expandable Swaddling Garment illustrated by FIG. 1, in an expanded configuration.
Figure 8:
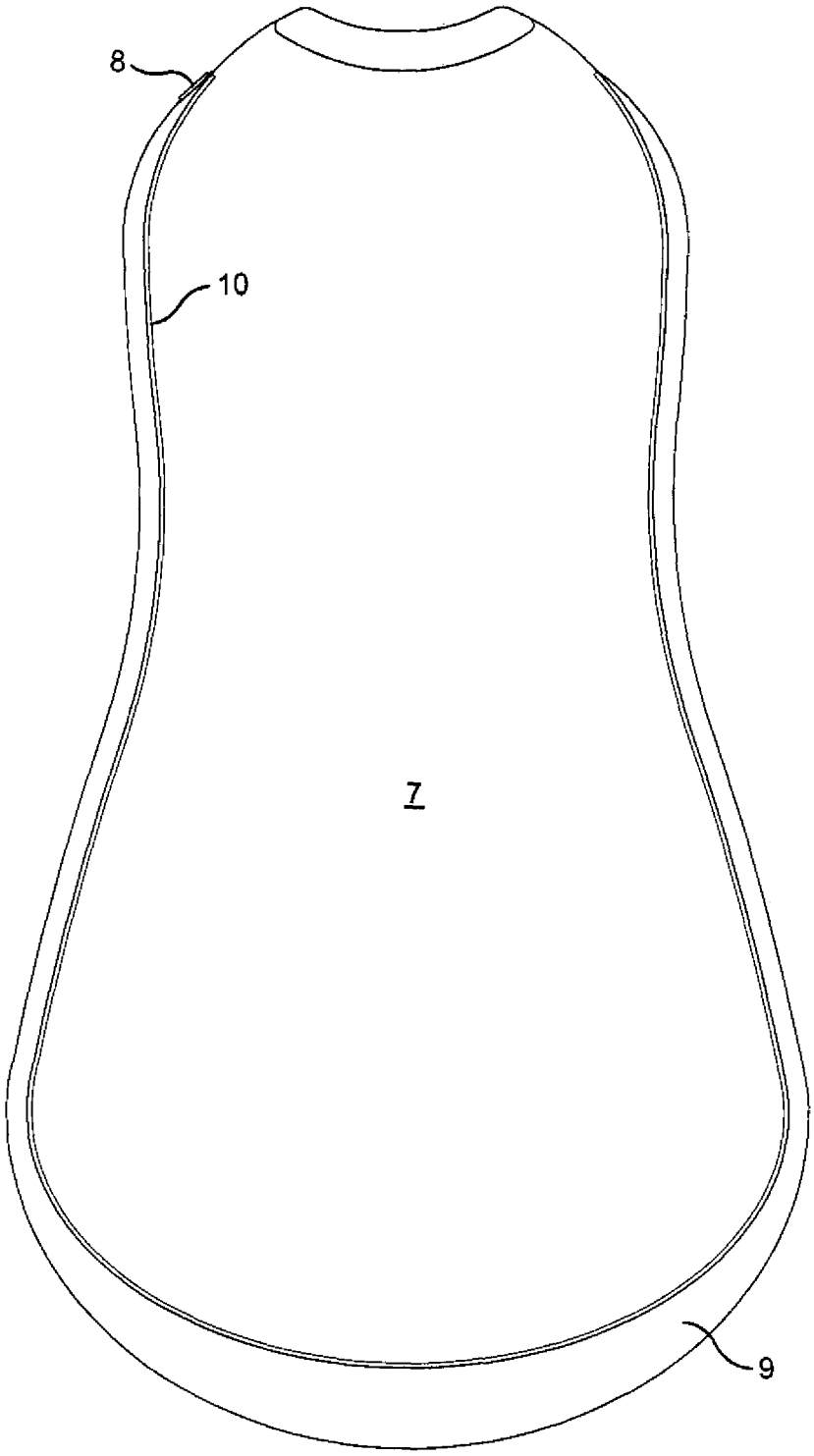
FIG. 8 illustrates a rear elevational view of the Expandable Swaddling Garment illustrated by FIG. 7.
Figure 9:
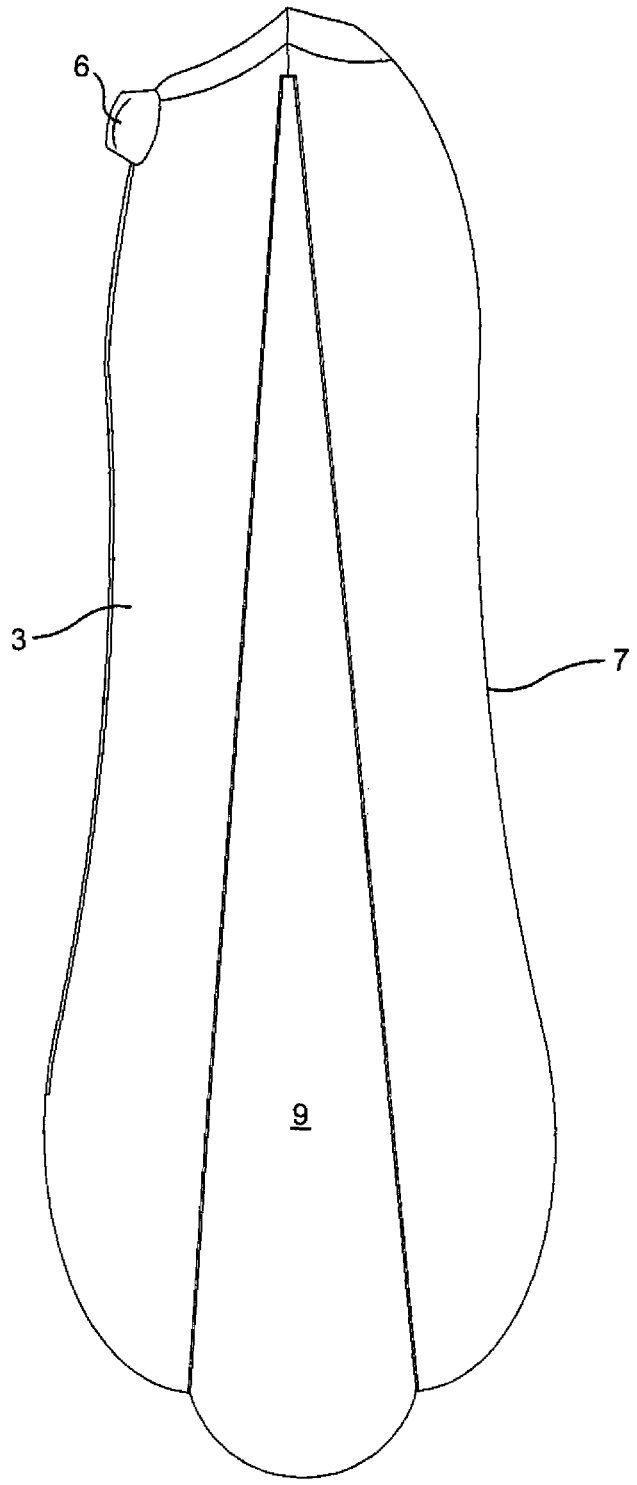
FIG. 9 illustrates a right side elevational view of the Expandable Swaddling Garment FIG. 7.
Figure 10:
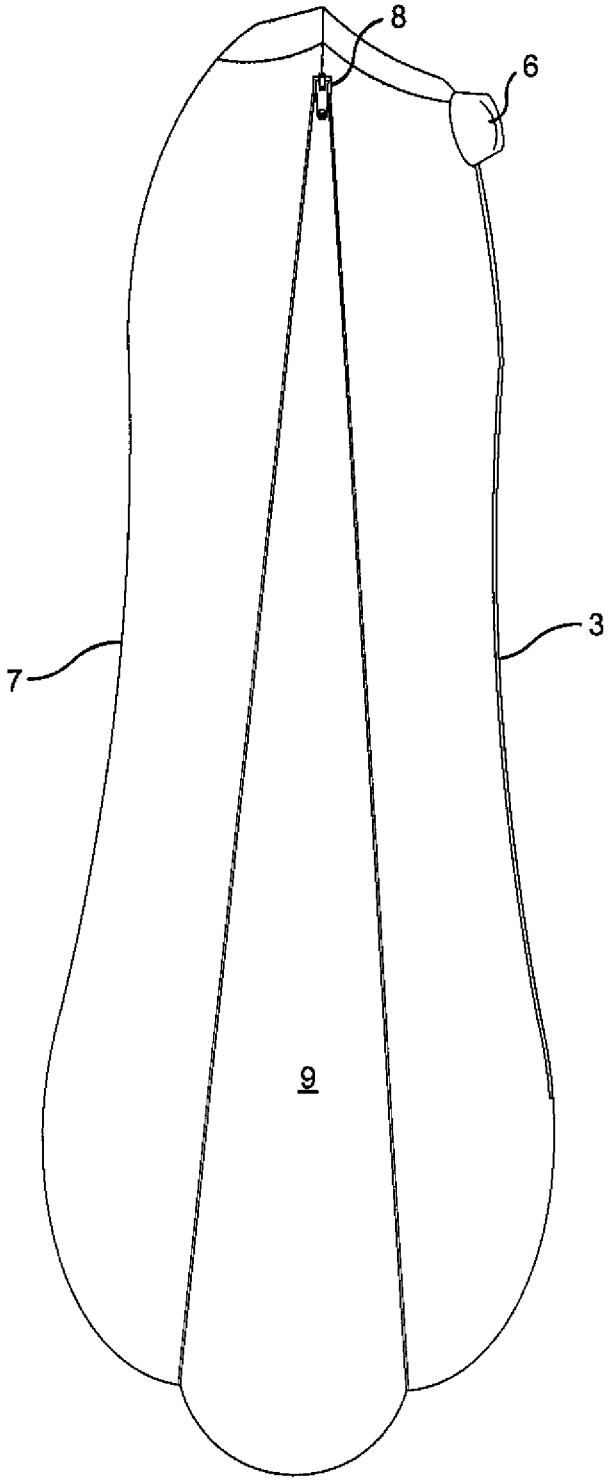
FIG. 10 illustrates a left side elevational view of the Expandable Swaddling Garment illustrated by FIG. 7.
Figure 11:
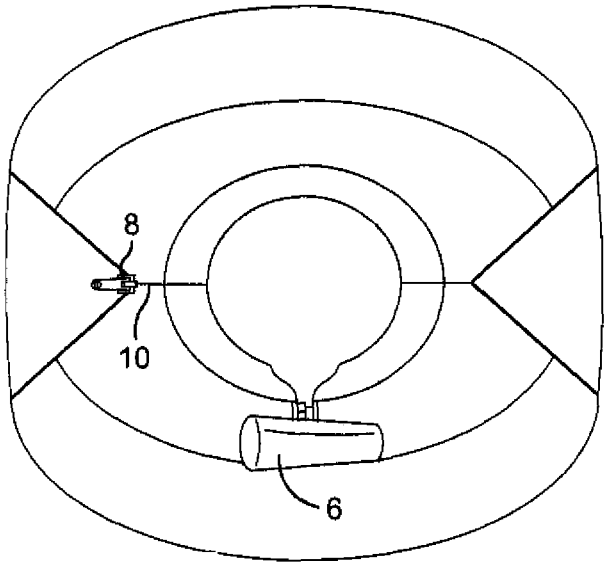
FIG. 11 illustrates a top plan view of the Expandable Swaddling Garment illustrated by FIG. 7.
Figure 12:
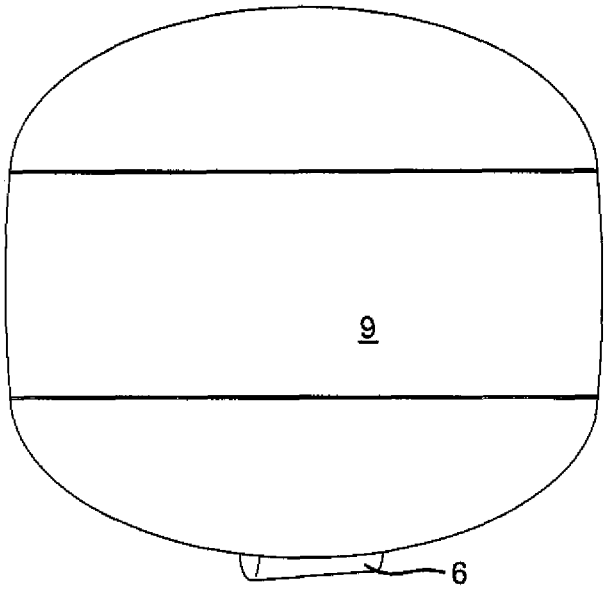
FIG. 12 illustrates a bottom plan view of the Expandable Swaddling Garment illustrated by FIG. 7.

As illustrated by FIGS. 1-6 of the drawings, the peanut shaped swaddling garment, generally designated by reference numeral 2, has a first central zipper 4 running along a vertical track 5 and a closure element 6 provided at the top of the front surface 3 of the garment to permit an infant to be placed in, and removed from, the main body of the garment. The rear surface of the garment is designated by reference numeral 7. A second zipper 8 runs along a track 10 provided at the periphery of the garment between the front and rear surfaces of the garment. The track 10 extends from proximate to the top of the garment at the right side thereof, along both sides and the bottom of the main body of the garment, and terminates proximate to the top of the garment at the left side thereof. As illustrated by FIGS. 1-6 of the drawing, the zipper is closed and the garment is in a contracted configuration. In this configuration, overlapping material, designated by reference numeral 9, extending between the front and rear surfaces 3 and 7 of the garment 2, is tucked inside of the main body of the garment and retained therein by the closed zipper 8.

FIGS. 7-12 of the drawings illustrate the infant garment of FIGS. 1-6 in an expanded configuration in which the zipper 8 along the periphery of the main body of the garment is opened. The opened zipper increases the volume within the main body of the garment by permitting the release of the overlapping material 9 tucked inside of the main body of the garment, thereby enabling the same garment to be used for an infant after the infant has outgrown the garment in its contracted configuration as illustrated by FIGS. 1-6 of the drawing.

The extent to which the garment is expandable can be controlled by the controlling the distance of separation between the front and rear surfaces of the garment when the garment is in its expanded configuration. The distance of separation between the front and rear surfaces 3 and 7 of the garment in its expanded configuration, when zipper 8 is opened, is determined by the amount of overlapping material tucked within the main body 2 of the garment. Thus, the maximum expansion of the volume of the garment is determined by the amount of overlapping material provided between the front and rear surfaces of the garment at the time the garment is manufactured.

It is also possible to expand only certain portions of the garment. For example, only the right side of the garment will be expanded if the zipper 8, illustrated by FIG. 1 of the drawing, is unzipped only to the bottom of the right side of the garment. Likewise, only the right side of the garment and the bottom of the garment will be expanded if the zipper 8 illustrated by FIG. 1 of the drawing is unzipped down the right side of the garment and across the bottom of the garment, but not up the left side of the garment. This will result in expanding the length of the garment to a maximum length, but not expanding the garment to a maximum width.

Figure 13:
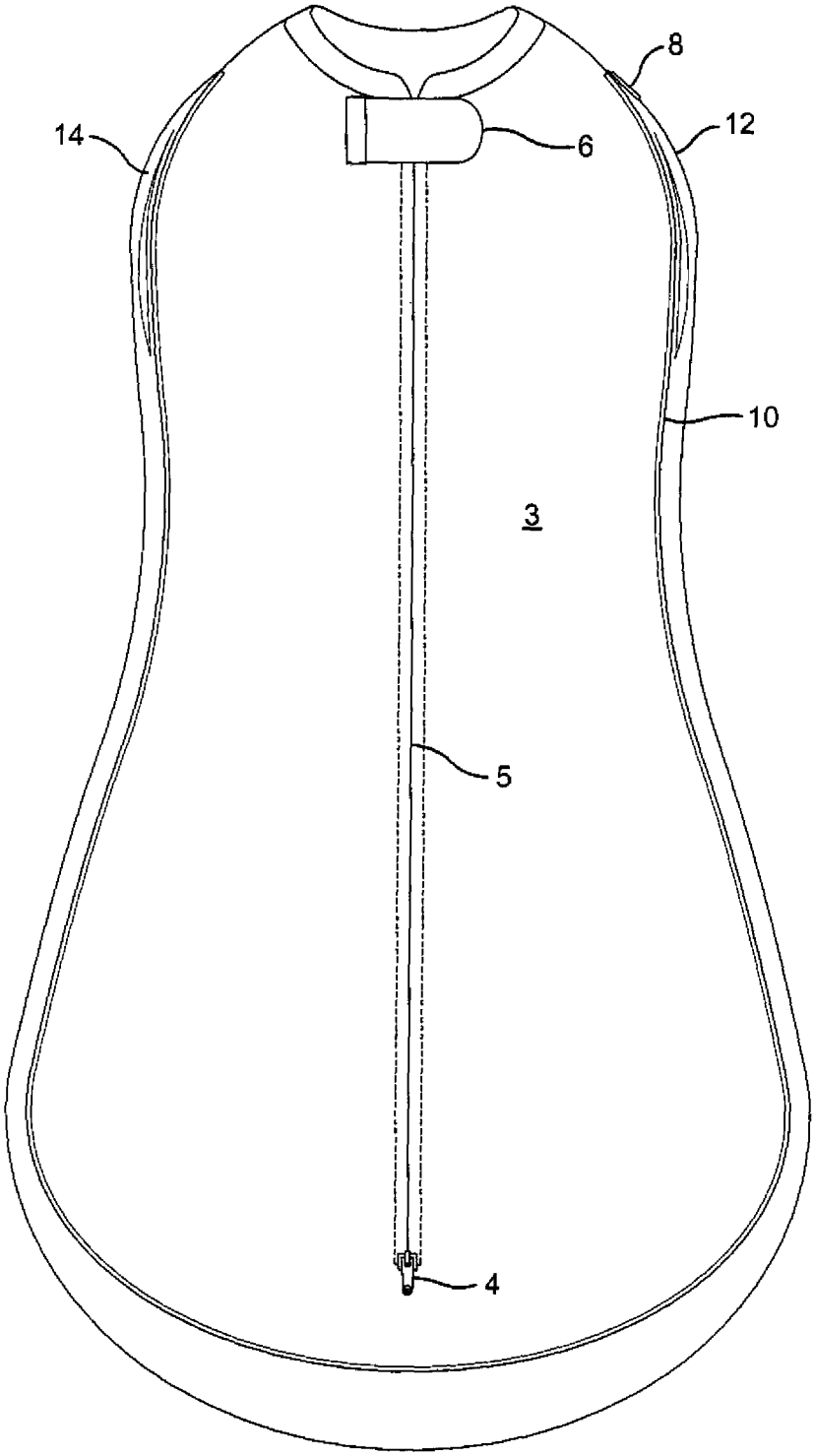
FIGS. 13-15 illustrate front and side views of a further embodiment of the Expandable Swaddling Garment in its expanded configuration.
Figure 14:
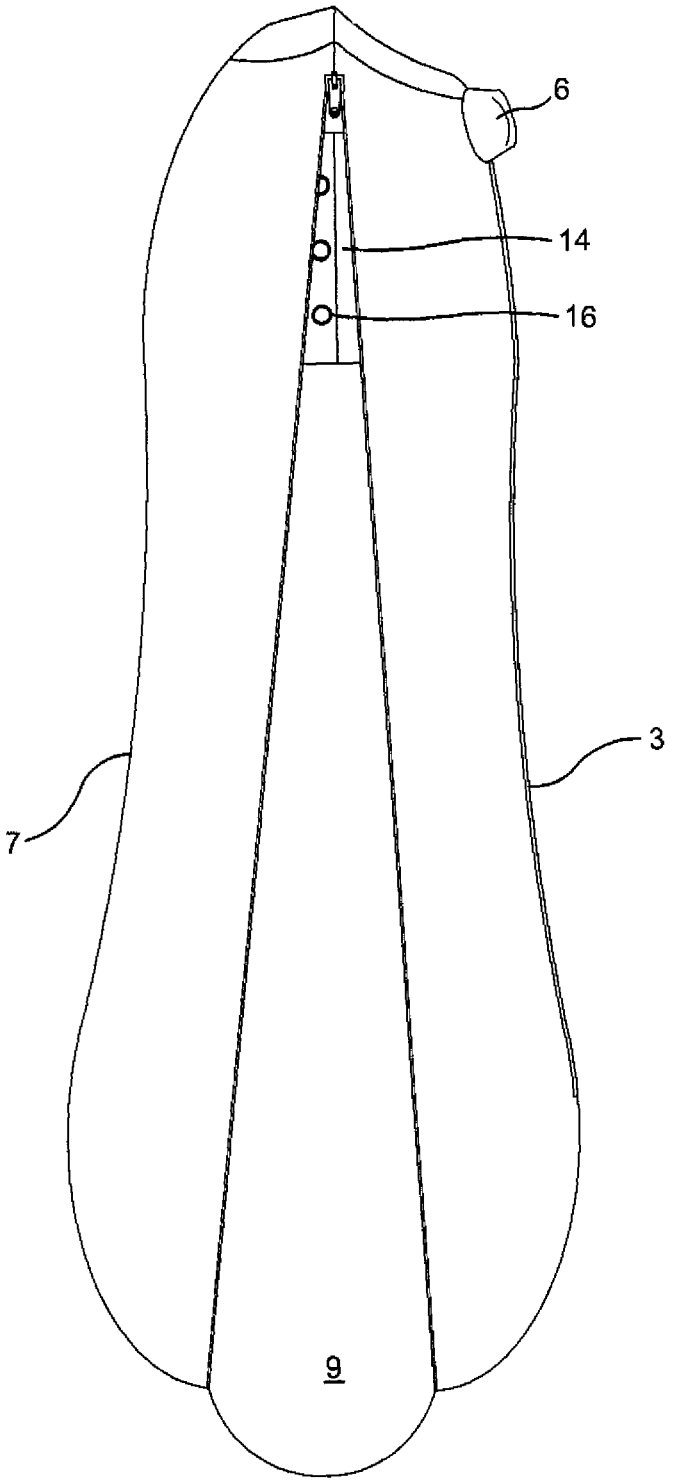
Figure 15:
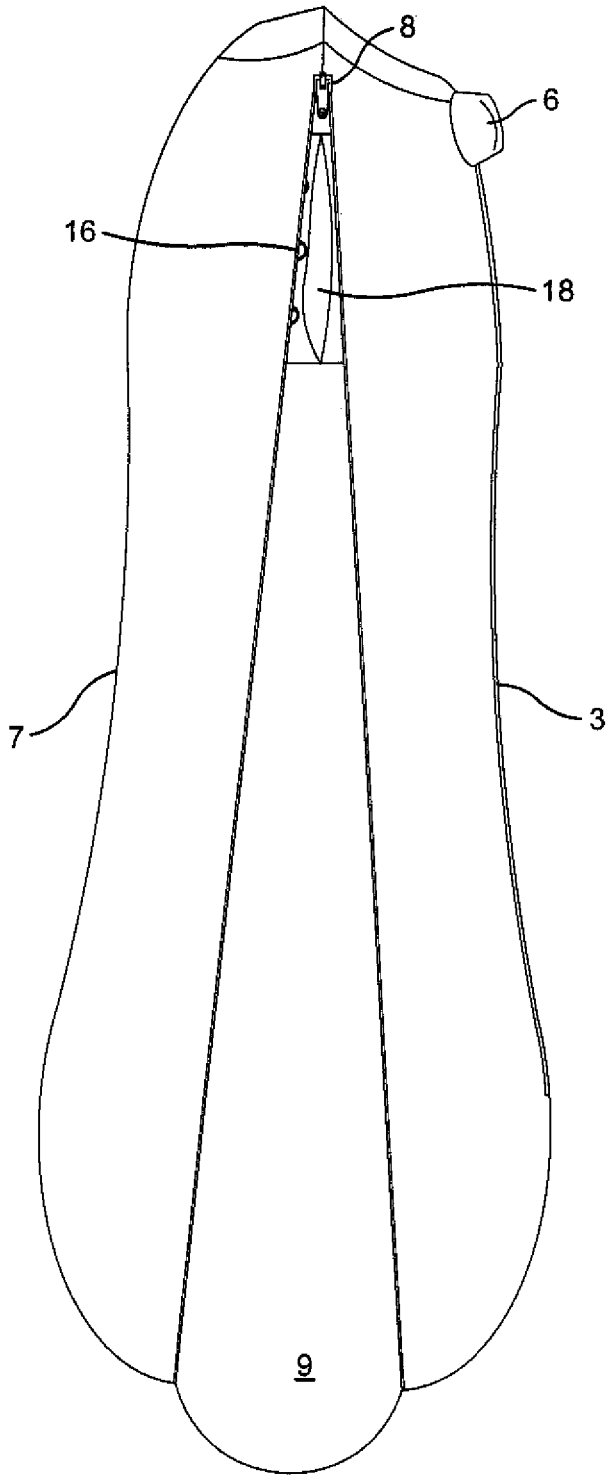

FIGS. 13, 14, and 15 illustrate a further embodiment of the expandable swaddling garment illustrated by FIGS. 1-12, in its expanded configuration as shown by FIGS. 7-12. FIG. 13 illustrates two closable flap sections, designated by reference numerals 12 and 14, at both arm areas of the garment near the top of the right and left sides of the garment. As illustrated by FIG. 13, each pair of flaps 12, 14 is closed by complementary snaps (not shown in this figure). In this configuration, the garment is closed so that it functions as a closed swaddle in its expanded configuration.

FIG. 14 is a right side elevational view of the garment of FIG. 13 in its expanded configuration with the closable pair of flaps 14 shown in a closed configuration in which the flaps 14 are closed by complementary snaps 16. The pair of flaps 12 on the left side of the garment are similarly closed by complementary snaps on the left side of the garment.

FIG. 15 illustrates the garment shown in FIG. 14 in which the complementary snaps 16 are opened to define a slit 18 on the right side of the garment, the slit 18 opening into the upper portion of the main body of the garment. The left side of the garment corresponds to the right side of the garment shown in FIG. 15 when the pair of snaps 12 on the left side are opened.

The complementary snaps 16 permit the pair of flaps 12, 14 on the left and right side of the garment to be opened or closed, at the selection of the user, to open or close the slits 18. When the slits 18 on both sides of the garment are opened, the arms of an infant received in the garment can extend through the open slits in an arms-free mode of use.

Figure 16:
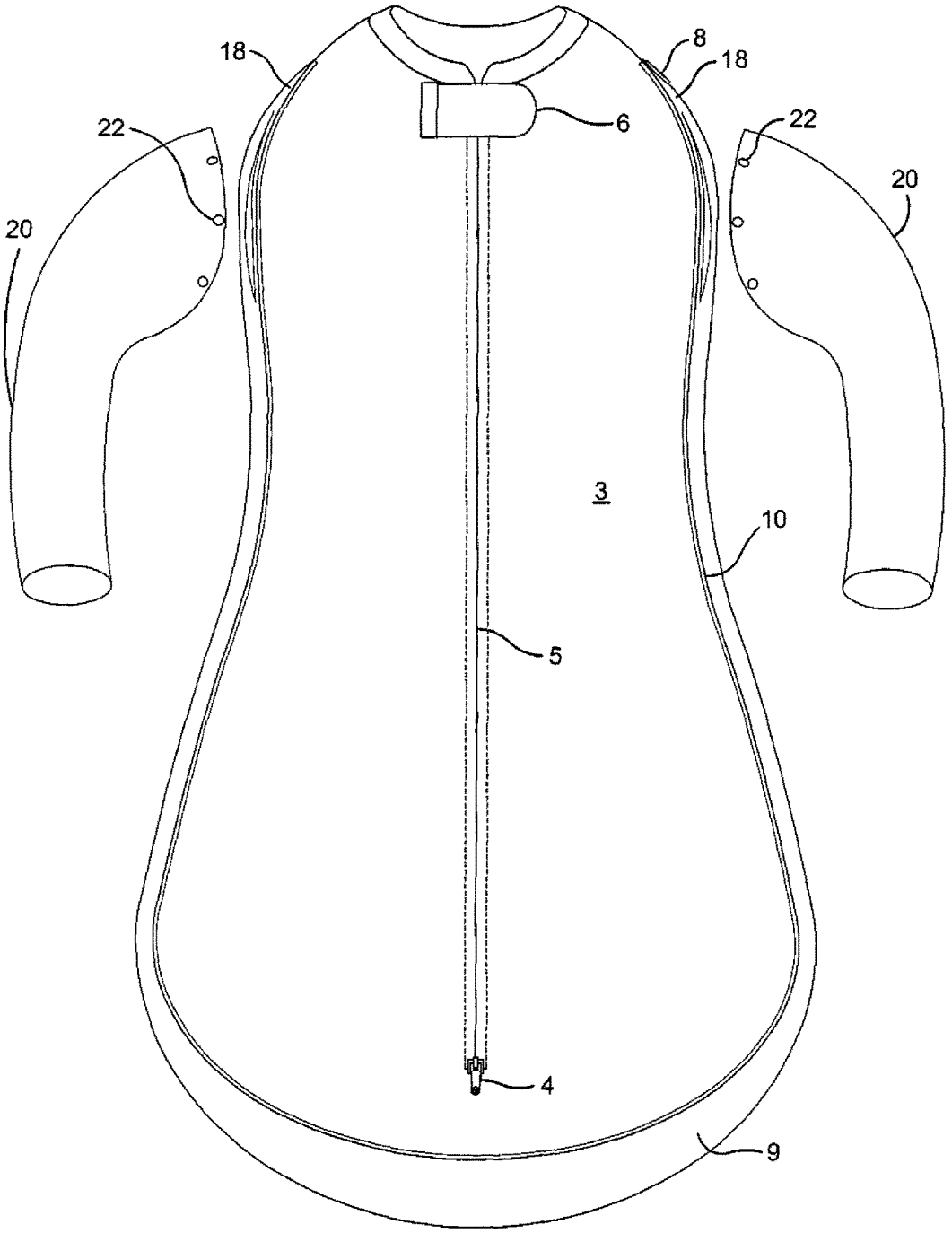
FIG. 16 illustrates a front elevational view of the embodiment of the Expandable Swaddling Garment illustrated by FIGS. 13-15 showing a pair of detachable sleeves.

FIG. 16 illustrates the garment shown by shown by FIG. 15 in which the snaps 16 are opened on both sides of the garment to expose the slits 18 defined on both sides of the garment. Two detachable sleeves designated by reference numeral 20, each having snaps 22 at the inner ends of the sleeves, are receivable within the open slits 18 and are removably attached to the garment by the snaps 18 on the garment and the complementary snaps 22 on the inner ends of the detachable sleeves 20.

Although FIGS. 13-16 employ snaps as the closure and/or attachment elements, other known attachment and closure means, including VELCRO or other adhesive strips, can be employed.

If the garment illustrated by FIG. 13 is to function only as a closed swaddle, the snaps 16 remain closed thereby closing the slits 18. The snaps 16, at the selection of the user, can be opened to open the slits 18 so that the garment functions in an arms free mode in which the arms of an infant within the garment extend outwardly from the garment through the open slits. The user may also select to open the snaps 16 to open the slits 18, and attach the snaps 22 on the sleeves 20 to the snaps 16 on the garment so that the sleeves are removably attached to the garment and the arms of the infant within the garment can extend outwardly through the open slits 18 and are received in the detachable sleeves 20.

Thus, the garment illustrated by FIGS. 13, 14, 15, and 15 can be used, at the selection of the user, in three separate ways, namely, as a closed swaddle, as a swaddle having arm openings for an infant's extended arms, and as a swaddle having detachable sleeves for an infant's extended arms.

Figure 17:
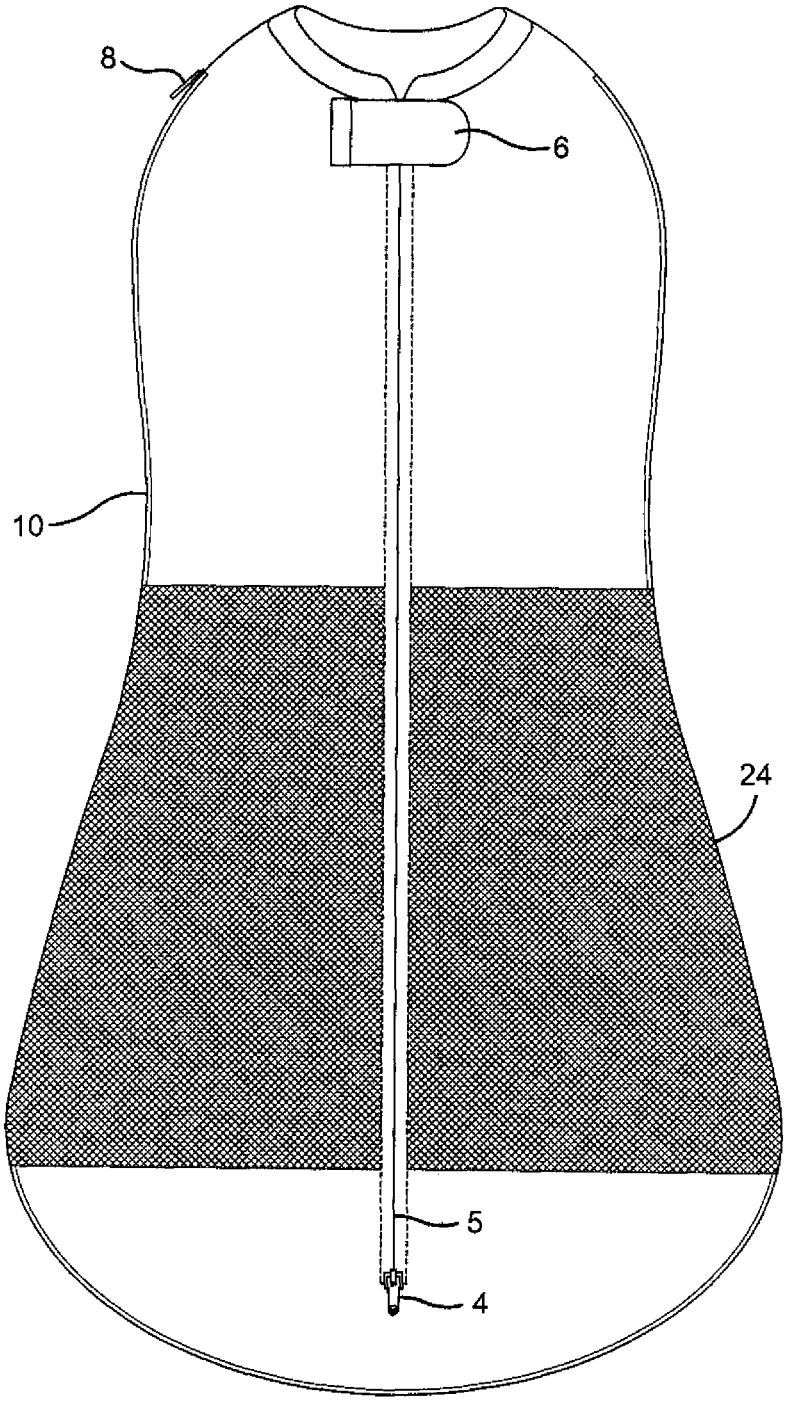
FIG. 17 illustrates a further modification to the embodiments illustrated by FIGS. 1-12 in which the majority of the bottom portion of the garment is formed from an expandable mesh material.

FIG. 17 of the drawing illustrates a front elevational view of the expandable swaddling garment in its contracted configuration in which at least a portion of the garment, preferably a section of the lower portion of the garment, is formed from an expandable mesh material designated by reference numeral 24.

The invention claimed is:

1. An infant swaddling garment comprising a main body formed from a front surface and a rear surface joined together, and an intermediate area of material extending between the front and rear surfaces of said main body of said garment around substantially the entire outer periphery of said main body for defining a predetermined space between said front and rear surfaces around substantially the entire outer periphery of said main body, and means for selectively adjusting said predetermined space between said front and rear surfaces for selectively adjusting the volume of said main body of said infant swaddling garment.

2. The swaddling garment as claimed in claim 1, wherein said front and rear surfaces of said main body of said garment are arranged to define a storage area therebetween for accommodating said material between said front and rear surfaces.

3. The swaddling garment as claimed in claim 1, wherein said means for adjusting said predetermined space between said front and rear surfaces of said garment is a zipper extending along at least one side of the main body of the garment.

4. The swaddling garment as claimed in claim 3, wherein said zipper extends substantially around the entire periphery of said main body of said garment.

5. The swaddling garment as claimed in claim 1, wherein the volume of said main body of the garment is selectively adjustable between a minimum volume and a maximum volume.

6. The swaddling garment as claimed in claim 5, wherein said front and rear surfaces of said main body of said garment are arranged to define a storage area therebetween for accommodating said material between said front and rear surfaces, and said minimum volume of said main body occurs when substantially all of said material between said front and rear surfaces is received with said storage area.

7. The swaddling garment as claimed in claim 5, wherein said maximum volume of said main body occurs when substantially all of said material between said front and rear surfaces extends between said front and rear surfaces.

8. The swaddling garment as claimed in claim 1, wherein said main body defines a pair of closable arm openings.

9. The swaddling garment as claimed in claim 8, wherein said arm openings have snaps for selectively opening and closing said arm openings.

10. The swaddling garment as claimed in claim 9, further including detachable sleeves for detachably connecting said sleeves to said arm openings.

11. The swaddling garment as claimed in claim 10, wherein said detachable sleeves include snaps complementary to the snaps on said arm openings for selectively detachably connecting said sleeves to said arm openings.

12. The swaddling garment as claimed in claim 1, wherein at least a portion of the main body of said garment is formed from a mesh material.

13. The swaddling garment as claimed in claim 1, wherein said intermediate material extends rearwardly from said front surface of said main body of said garment.

14. The swaddling garment as claimed in claim 1, wherein said intermediate material extends forwardly from said rear surface of said main body of said garment.

15. The swaddling garment as claimed in claim 1, wherein said intermediate material extends rearwardly from said front surface of said main body of said garment and forwardly from said rear surface of said main body of said garment.

* * * * *